US010301979B2

(12) United States Patent
Kubota

(10) Patent No.: US 10,301,979 B2
(45) Date of Patent: May 28, 2019

(54) HYDRAULIC LASH ADJUSTER

(71) Applicant: NITTAN VALVE CO., LTD., Hadano-shi, Kanagawa (JP)

(72) Inventor: Yukio Kubota, Hadano (JP)

(73) Assignee: NITTAN VALVE CO., LTD., Hadano-shi (JP)

( * ) Notice: Subject to any disclaimer, the term of this patent is extended or adjusted under 35 U.S.C. 154(b) by 399 days.

(21) Appl. No.: 14/913,111

(22) PCT Filed: Aug. 21, 2013

(86) PCT No.: PCT/JP2013/072315
§ 371 (c)(1),
(2) Date: Feb. 19, 2016

(87) PCT Pub. No.: WO2015/025385
PCT Pub. Date: Feb. 26, 2015

(65) Prior Publication Data

US 2016/0208660 A1 Jul. 21, 2016

(51) Int. Cl.

| | |
|---|---|
| ***F01L 1/14*** | (2006.01) |
| ***F01L 1/24*** | (2006.01) |
| ***F15B 15/14*** | (2006.01) |
| ***F15B 15/24*** | (2006.01) |

(52) U.S. Cl.
CPC ..... *F01L 1/24* (2013.01); *F01L 1/2405* (2013.01); *F15B 15/149* (2013.01); *F15B 15/1428* (2013.01); *F15B 15/1447* (2013.01); *F15B 15/24* (2013.01)

(58) Field of Classification Search
CPC ..... F01L 1/24; F01L 1/2405; F15B 15/149
USPC ..... 123/90.52, 90.55
See application file for complete search history.

(56) References Cited

U.S. PATENT DOCUMENTS

2011/0041791 A1 2/2011 Miyoshi et al.

FOREIGN PATENT DOCUMENTS

| | | | |
|---|---|---|---|
| DE | 482512 | A | 9/1929 |
| DE | 497940 | A | 5/1930 |
| DE | 2438444 | A1 | 2/1975 |
| DE | 195 29 044 | A1 | 2/1997 |
| DE | 102008048515 | A1 | 3/2010 |
| GB | 538952 | A | 8/1941 |

(Continued)

OTHER PUBLICATIONS

International Search Report dated Nov. 26, 2013, issued in counterpart Application No. PCT/JP2013/072315 (2 pages).

(Continued)

*Primary Examiner* — Ching Chang
(74) *Attorney, Agent, or Firm* — Westerman, Hattori, Daniels & Adrian, LLP

(57) ABSTRACT

The invention provides a hydraulic lash adjuster equipped with a cost effective dropout preventing mechanism for preventing a plunger from dropping out of a housing. The lash adjuster comprises: a cylindrical bottomed housing (3), a plunger (2), housed inside the housing (3), having an outer periphery in contact with the inner periphery of the housing (3), and a dropout preventing mechanism (14). The dropout preventing mechanism (14) comprises a first groove (11) formed in the inner circumferential periphery of the housing (3) and a second groove (12) formed in the outer circumferential periphery of the plunger (2) in opposition to the first groove (11), and a flexible linear member 4 disposed in the first and the second grooves (11) and (12).

2 Claims, 3 Drawing Sheets

(56) References Cited

FOREIGN PATENT DOCUMENTS

| | | | |
|---|---|---|---|
| GB | 1467305 | A | 3/1977 |
| GB | 1566047 | A | 4/1980 |
| JP | 58-186106 | U | 12/1983 |
| JP | 9-32890 | A | 2/1997 |
| JP | 2006-322438 | A | 11/2006 |
| JP | 2011-141006 | A | 7/2011 |
| JP | 5269199 | B2 | 8/2013 |
| WO | 2012/095203 | A1 | 7/2012 |

OTHER PUBLICATIONS

English translation of Korean Office Action dated Sep. 18, 2017, issued in counterpart Korean Application No. 10-2015-7034221. (5 pages).
Extended (supplementary) European Search Report dated Mar. 29, 2017, issued in counterpart European Application No. 13891963.4. (7 pages).
English translation of Office Action dated Nov. 3, 2017, issued in counterpart Chinese Application No. 201380077664.1. (8 pages).

HYDRAULIC LASH ADJUSTER

TECHNICAL FIELD OF THE INVENTION

This invention relates to a hydraulic lash adjuster for automatically controlling a clearance of an engine valve.

BACKGROUND ART

A lash adjuster used in a valve system of an engine functions on one hand as a fulcrum of a rocker arm bearing thereon an engine valve and on the other hand as a mechanism for automatically adjusting a clearance of the valve (or valve clearance). A hydraulic lash adjuster has a housing in the form of a generally bottomed cylinder and a plunger moveably supported by the housing. The plunger can extend/contract in response to a force exerted by the rocker arm to automatically adjust the valve clearance.

It should be noted here that the plunger and the housing must be temporarily secured by means of some dropout preventing mechanism before they are mounted on an engine in order to prevent the plunger from dropping out of the housing during transportation.

Patent Document 1 cited below discloses a hydraulic lash adjuster in paragraph [0043] and in FIGS. 1 and 5, in which a housing (or body of the adjuster) is provided with an inner circumferential stepped-recess formed in one leading end section of the housing, a plunger formed with an outer circumferential stepped-recess, and a metal retainer (in the form of a ring 24*d*) with one end thereof abutting against the inner circumferential recess and the other end caulked in the outer circumferential recess to thereby prevent the plunger from coming off the housing.

[0043] and in FIGS. 1 and 5, in which a housing (or body of the adjuster) is provided with an inner circumferential stepped-recess formed in one leading end section of the housing, a plunger formed with an outer circumferential stepped-recess, and a plunger-retaining metal ring 24*d* with one end thereof abutting against the inner circumferential recess and the other end caulked in the outer circumferential recess to thereby prevent the plunger from coming off the housing.

PRIOR ART DOCUMENTS

Patent Documents

Patent Document 1: JP5269199.

SUMMARY OF THE INVENTION

Objects to be Achieved by the Invention

The hydraulic lash adjuster disclosed in Patent Document 1 must prepare a dedicated retainer for temporarily secure the plunger in the housing, although the dedicated parts are not needed after the lash adjuster is mounted on the engine. Obviously, use of dedicated parts and a dedicated working machine in establishing a dropout preventing mechanism for stopping the plunger from dropping off the housing results in a disadvantageous increase in manufacturing cost of a lash adjuster.

In view of such prior art problem as discussed above, the present invention provides a hydraulic lash adjuster equipped with a cost effective dropout preventing mechanism for stopping its plunger from dropping off its housing.

Means of Achieving the Objects

An inventive hydraulic lash adjuster recited in claim 1 comprises:

a cylindrical housing having a bottom;

a plunger held in the housing, with the outer periphery of the plunger in contact with an inner periphery of the housing;

a first circumferential groove formed in an outer periphery of the plunger; and a second circumferential groove formed in an inner periphery of the housing in opposition to the first groove, the hydraulic lash adjuster characterized by further comprising:

a linear member insertion hole penetrating from the outer periphery to the inner periphery of the housing and communicated with a space formed between the first and the second grooves; and a flexible linear member inserted in the first and the second grooves simultaneously in the circumferential direction through the linear member insertion hole.

(Function) As the plunger moves along its center axis towards an open end of the housing, the linear member inserted in a space between the first groove of the plunger and the second groove of the housing comes into contact with axially opposite end portions of the first and the second grooves. thereby preventing the plunger from coming out of the housing. The linear member can be made of any flexible material without using any dedicated special machining tool, and can be inserted in a space between the first and the second grooves.

The linear member is inserted into the space formed between the first groove of the plunger and the second groove of the housing through the linear member insertion hole after the plunger is mounted in the housing.

In contrast, in a conventional lash adjuster (as disclosed in JPA 2008-298040 for example), a plunger is inserted into a housing with a pair of plunger retaining members mounted on a base section of the plunger under a radially outward biasing force of a spring. Under the biasing force of the spring, leading ends of the retaining members are forced into the inner recess formed in the base section of the housing, thereby preventing the plunger from coming off the housing. However, since a retaining member of the conventional plunger is inserted in the housing in forced abutment against the inner periphery of the housing, the retaining members could damage the inner periphery of the housing.

The linear member of the hydraulic lash adjuster recited in claim 1 will never damages the inner periphery of the housing since it is installed only after the plunger is mounted in the housing.

The hydraulic lash adjuster may be configured in such a way that at least one of the first and the second grooves is an elongate groove extending in the direction of the center axis of the lash adjuster such that said one groove has an axial length greater than a maximum moveable distance of the plunger relative to the housing during a period of adjusting a valve clearance.

(Function) The lash adjuster can move in the housing without being blocked by the linear member that stays in the first and the second grooves. Consequently, the lash adjuster can be mounted on the engine with the linear member held in the space between the first and the second grooves.

The hydraulic lash adjuster may be configured in such a way that the linear-member insertion hole is an oil supply passage.

(Function) The linear member is externally inserted into the space between the first and the second grooves through the oil supply passage after the plunger is mounted in the housing.

The hydraulic lash adjuster may be configured in such a way that the first and the second grooves are formed all around the entire circumference of the housing and of the plunger, and the linear member is disposed on the entire length of the grooves in the space between the first and the second grooves of the plunger.

(Function) With the linear member circumferentially extending throughout the space formed by the first and the second grooves, a total area of the linear member in contact with the grooves is increased, thereby enhancing a retaining force of the linear member retaining the plunger in the housing.

Effects of the Invention

The hydraulic lash adjuster recited in claim 1 can be manufactured at low cost since it does not requires no dedicated part such as a retainer nor no caulking machine for establishing a dropout preventing mechanism.

Further, since the linear member can be easily mounted in the housing without damaging the inner periphery of the housing, the invention enabling manufacture of the lash adjuster at low cost.

According to the hydraulic lash adjuster, since no work is required to remove the linear member from the first and the second grooves after the plunger is temporarily secured in the housing, manufacturing cost of the hydraulic lash adjuster is further reduced.

According to the hydraulic lash adjuster, the linear member can be easily mounted in the lash adjuster without damaging the inner periphery of the housing, thereby enabling manufacture of the lash adjuster at still lower cost.

According to the hydraulic lash adjuster, the linear member insertion hole is substituted by an oil supply passage, there is no need of providing a new linear member insertion hole, thereby enabling manufacture of the lash adjuster at low cost.

According to the hydraulic lash adjuster, the plunger is more firmly secured in the housing than a plunger secured by a linear member that extends only partly along the circumferences of the first and the second grooves.

BRIEF DESCRIPTIONS OF THE DRAWINGS

BEST MODE FOR CARRYING OUT THE INVENTION

Referring to FIGS. 1 through 5, embodiments of the present invention will now be described in detail.

In what follows, different directions of the hydraulic lash adjuster shown in FIGS. 1 through 5 are defined as follows. A longitudinal upward and downward direction of the adjuster as viewed in FIG. 1 will be referred to as "Up direction and Lo direction", respectively; any radially outward direction from the center (longitudinal) axis L0 of the plunger 2 (and of the housing 3), "Ro direction"; any radially inward direction towards the center axis L0, "Ri direction".

Figure 1:
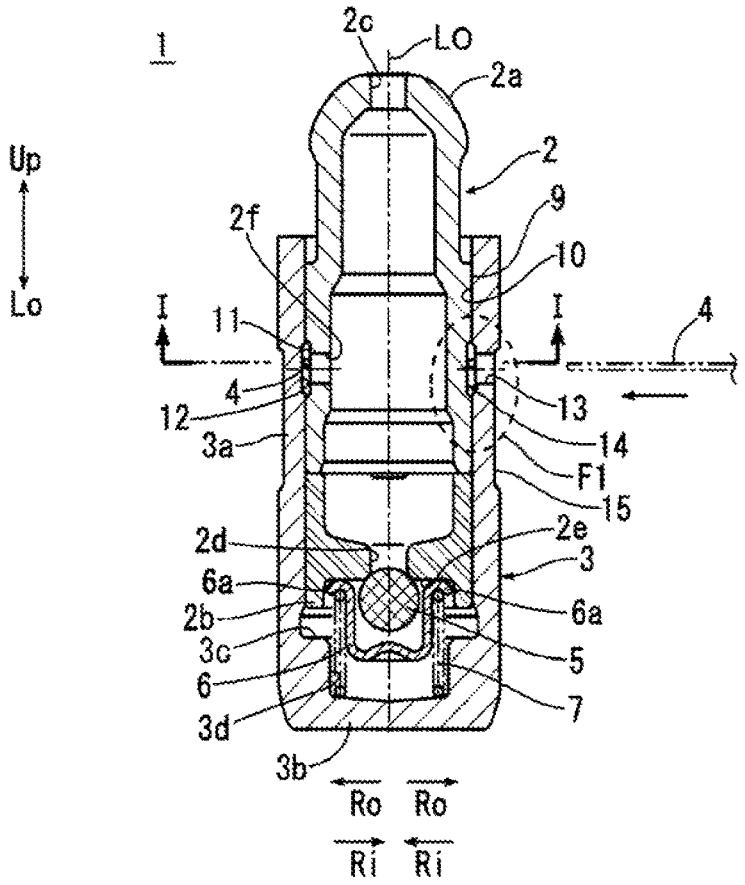
FIG. 1 is a longitudinal cross section of a hydraulic lash adjuster of a first embodiment according to the invention.

A hydraulic lash adjuster 1 embodying the invention comprises a plunger 2, a housing 3, a linear member 4, a steel ball 5, a holder member 6, and a compressed spring 7, as shown in FIG. 1.

The plunger 2, housing 3, linear member 4, steel ball 5, holder member 6 for holding the plunger 2 and the steel ball 5, and the compressed spring 7 are all made of heat resisting metal. The linear member 4 is made of a resin such as polyester or a metal such as a SWP (which is a piano wire rod) and SUS (which is a stainless steel), since they have suitable flexibility and heat resistance.

The plunger 2 is a hollow cylinder in shape having a ring shape transverse cross section, and is provided with a pair of holes (2*c* and 2*d*) formed at a base section 2*b* and a top end section 2*a* of the cylinder. A top end section 2*a* of the plunger 2 has a substantially semi-spherical shape to swingably support a rocker arm (not shown). The plunger 2 is provided at its base section 2*b* with a stepped recess 2*e* and a hole 2*d* formed in the stepped recess 2*e*. The housing 3 is a generally cylindrical section 3*a*, which has a center axis L0 and a closed bottom 3*b* at its base section, so that it has a ring shape cross section perpendicular to the center axis L0. The plunger 2 has an outer periphery 9 which has substantially the same outer diameter as the inner diameter of the inner periphery 10 of the cylindrical section 3*a* of the housing 3.

Formed at the base section of the inner periphery 10 of the housing 3 is a spring holder 3*d* contiguously with a step section 3*c* of the housing 3. The spring holding section 3*d* has a smaller inner diameter than that of the cylindrical section 3*a*. The compressed spring 7 is held in position in engagement with the spring holder 3*g*. The holder member 6 has a leading end section 6*a* that extends radially outwardly with respect to the center axis L0 and engages with the inner periphery of the recess 2*e*. Thus, the holder member 6 is mounted on the recess 2*e*. The steel ball 5, sandwiched between the holder member 6 and the stepped recess 2*e* of the plunger 2, is held at a position to face the hole 2*d*.

The plunger 2 is mounted on the ball retainer 6 and inserted inside the cylindrical section 3*a* of the housing 3, leaving a minute clearance between the outer periphery 9 of the plunger 2 and the inner periphery 10 of the housing 3. The magnitude of this clearance is equal to the inner diameter of the inner periphery 10 of the housing 3 minus the outer diameter of the outer periphery 9 of the plunger 2. The plunger 2, with its holder member 6 in contact with the compressed coil spring 7, is held inside the housing 3 as it is urged upward by a biasing force of the compressed spring 7.

Figure 2:
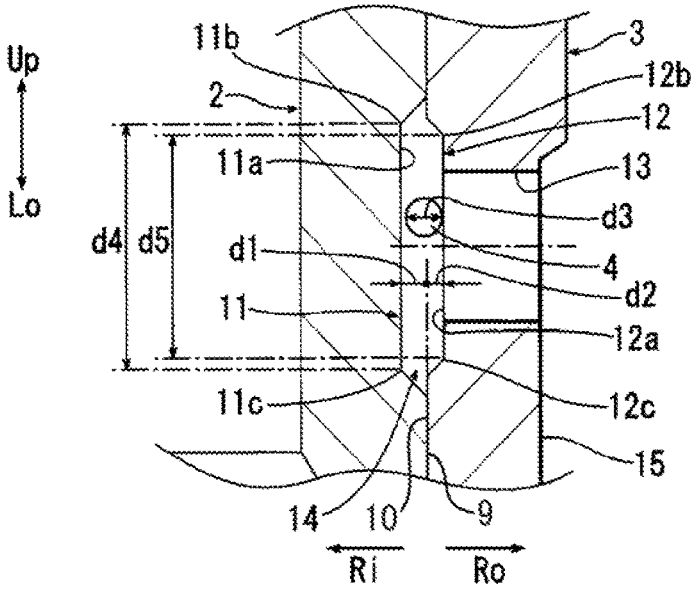
FIG. 2 shows in enlarged view a portion F1 of FIG. 1, illustrating a first groove formed in a plunger, a second groove formed in a housing, and a linear member.

As shown in FIGS. 1 and 2, the plunger 2 is provided in the outer periphery 9 thereof with a first circumferential groove 11 recessed radially inwardly from the outer periphery towards the center axis L0 (i.e. in Ri direction), while the housing 3 is provided in the inner periphery 10 thereof with a second circumferential groove 12 recessed radially outwardly (in Ro direction), away from the center axis L0. The linear member 4, first groove 11, and second groove 12 together constitute a dropout preventing mechanism 14 for stopping the plunger 2 from coming off the housing 3.

In the example shown herein, the linear member 4 has a cylindrical shape of diameter d3 and each of the first and the second grooves 11 and 12, respectively, is an elongate groove having an axial length larger than the diameter d3 (as described in detail later in connection with an embodiment). The grooves 11 and 12 are formed to face each other when the plunger 2 is inserted in the housing 3 and is held in position by a compressed coil spring 7.

The housing 3 is force fitted in a hole formed at an upper opening of a cylinder head (not shown). A lubrication oil, such as engine oil, is supplied from an oil supply passage (not shown) into a space between the hole and the outer periphery of the housing 3. The housing 3 is formed with an oil gallery oil passage 13 that penetrates from the outer periphery 15 to the inner periphery 10 of the housing 3. This oil passage 13 is communicated with both of the first groove 11 and the second groove 12.

Figure 3:
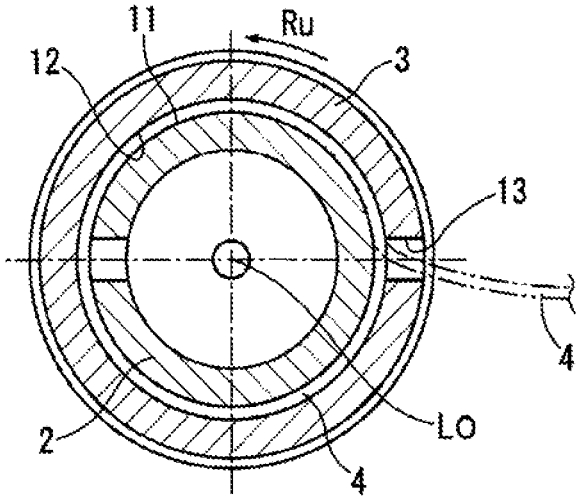
FIG. 3 is a cross section taken along line I-I in FIG. 1.

The linear member 4 is inserted into both grooves 11 and 12, as shown in FIGS. 1 and 3. The lubricant oil is injected from an oil passage 13 formed between a hole (not shown) formed in the cylinder head and the outer periphery of the housing 3 into the hydraulic lash adjuster 1 equipped with the linear member 4. The lubrication oil is injected into the first and the second grooves 11 and 12, a space between the plunger 2, and into the interior of the housing 3 via a hole 2*f* formed in the plunger 2 and communicated with the interior.

The width of the linear member 4 in a radial direction of the plunger 2 and the housing 3 linear member 4 is larger than either depth of the first groove 11 or the second groove 12. As a consequence, the linear member 4 occupies spaces that belong to the first groove 11 and the second groove 12, thereby preventing the plunger 2 from dropping out of the housing 3. In a case, for example, if a minute clearance d0 (not shown) between the outer periphery 9 of the plunger 2 and the inner periphery 10 of the housing 3 is 0.01, the depth d1 of the first groove 11 shown in FIG. 2 is 0.3 mm, the depth d2 of the second groove 12 is 0.2 mm, and the linear member 4 has a round cross section and has a diameter d3 in the range from 0.3 mm to d0+d1+d2 (=0.51 mm) inclusive, then the linear member 4 can prevent dropping of the plunger 2. Preferably, the diameter of the linear member 4 is equal to d0+d1+d2, as in the present example, in order to allow the linear member 4 to exhibit a maximum stopping effect when in contact simultaneously with the first groove 11 as well as the second groove 12.

Leading ends and tailing ends of the first groove 11 and the second groove 12 have slopes inclined with respect to the bottoms 11*a* and 12*a* of the grooves 11 and 12, respectively, in such a way that the apertures of the grooves (that is, axial lengths of the grooves) widen from their bottoms towards their upper open ends, as shown in FIG. 3. The linear member 4 can move between two boundaries 11*b* and 11*c* or between two boundaries 12*b* and 12*c*, where the boundaries 11*b* and 11*c* are boundaries between the bottom 11*a* of the first groove 11 and its slopes, while the boundaries 12*b* and 12*c* are boundaries between the bottom 12*a* of the second groove 12 and their slopes.

Denoting by d4 the distance between the boundaries 11*b* and 11*c*, by d5 the distance between the boundaries 11*b* and 11*c*, and by d6 (not shown) the maximum distance along the center axis L0 of the housing 3 allowed for the plunger to move for adjustment of a valve clearance under a pressure exerted by the rocker arm, and assuming that the first groove 11 and the second groove 12 are formed to satisfy a condition d4≥d5, it is seen that the groove 11 is formed to satisfy d4≥d6. Then, the housing 3 will not hinder bobbing motions of the plunger 2 relative to the housing 3 if the linear member 4 is moved in the grooves 11 and 12 along the center axis L0) along the center axis L0. As a result, the linear member 4 needs not be withdrawn from the first groove 11 nor from the second groove 12 in the event that the lash adjuster 1 is installed in an engine (not shown), thereby reducing the number of steps in the manufacture of the hydraulic lash adjuster.

It should be understood that the cross sectional shape of the linear member 4 is not limited to a circle, and in fact a linear member of any transverse cross section can be used. Further, one of the first groove 11 and the second groove 12 may have a shape that fits the outer profile of the linear member 4, so as to prohibit the axial movement of the linear member 4 along the center axis L0. The linear member 4 may be inserted through the oil supply passage 13 into a first and a second groove 11 and 12, respectively, which are formed to communicate with the oil supply passage 13 but extend only partially along the circumference of the plunger 2 and the housing 3.

Figure 4:
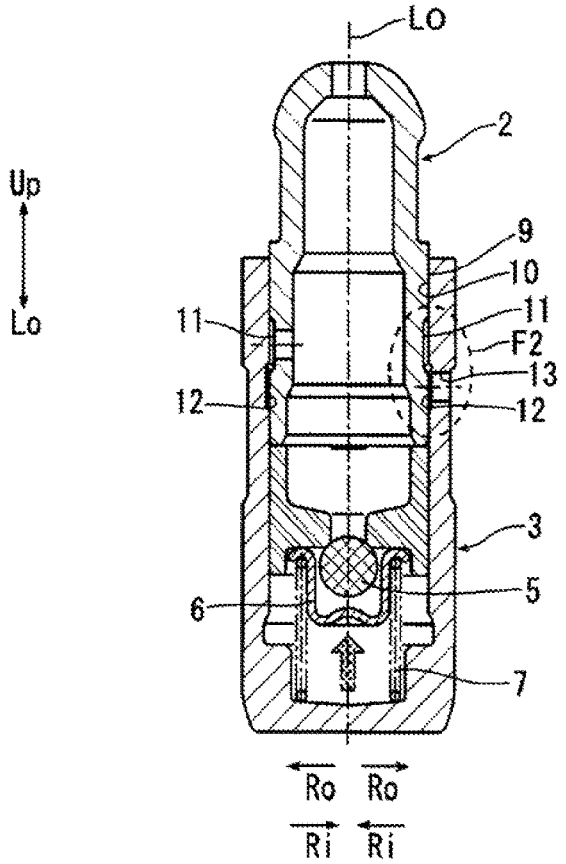
FIG. 4 is a longitudinal cross section of the lash adjuster, illustrating a plunger secured in the housing by means of a dropout preventing mechanism.
Figure 5:
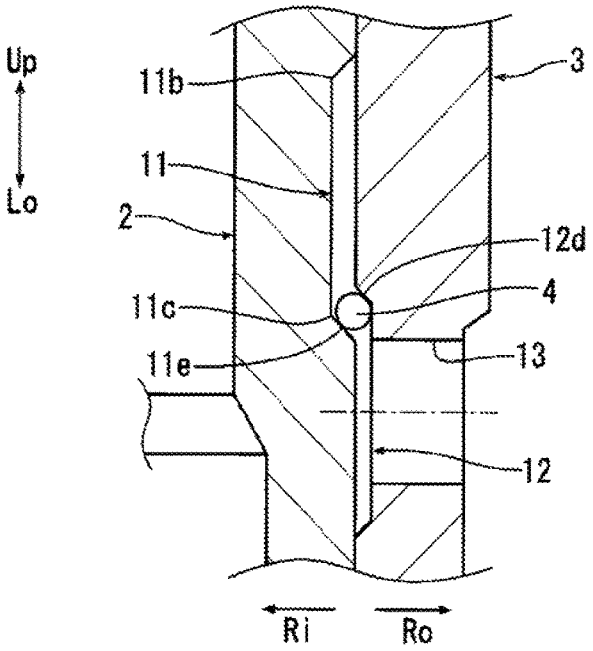
FIG. 5 shows in enlarged view a cross section of a portion F2 of FIG. 4, illustrating a first groove formed in the plunger, a second groove formed in the housing, and a linear member.

Finally, referring to FIGS. 4 and 5, a dropout preventing mechanism 14 for stopping the plunger 2 from dropping out of the housing 3 will be now described. If the plunger 2 happens to extend towards the leading end of the housing 3 (in the upward direction) due to wobbling of the plunger 2 in the housing 3 during its transportation, the linear member 4 is sandwiched between the lower inclined portion lie of the groove 11 and the upper inclined portion 12*d* of the second groove 12 of the housing 3. As a consequence, the plunger 2 cannot extend any more, and is held within the housing 3.

Should a valve clearance between the engine valve (not shown) and the rocker arm (not shown) is increased, the plunger 2 extends towards the leading end of the housing 3 (that is, in the upward direction) relative to the housing 3 in response to a change in external pressure exerted by the rocker arm, thereby decreasing the valve clearance However, since the distance d4 between the boundaries 11*b* and 11*c* of the first groove 11 is set up to exceed the maximum moveable distance d6 of the plunger 2 relative to the housing 3, the linear member 4 will not hinder adjustment of valve clearance during a valve clearance operation if the linear member 4 is mounted in the hydraulic lash adjuster 1 of the engine (not shown).

BRIEF DESCRIPTIONS OF REFERENCE NUMERALS

1 hydraulic lash adjuster
2 plunger
3 housing
4 linear member
9 outer periphery of plunger
10 inner periphery of housing
11 first groove of plunger
12 second groove of housing
13 oil passage
14 dropout preventing mechanism
d4 length of first groove
d6 maximum moveable distance of plunger during adjustment of valve clearance
L0 center axis of lash adjuster

The invention claimed is:

1. A hydraulic lash adjuster, comprising:

a cylindrical housing having a bottom;

a plunger held in the cylindrical housing, with an outer periphery of the plunger being in contact with an inner periphery of the cylindrical housing;

a first circumferential groove formed in the outer periphery of the plunger;

a second circumferential groove formed in the inner periphery of the cylindrical housing in opposition to the first circumferential groove;

a linear member insertion hole penetrating from the outer periphery to the inner periphery of the cylindrical housing and communicated with a space formed between the first and the second circumferential grooves; and a flexible linear member having a shape that fits through the linear member insertion hole, the flexible linear member being disposed in the first and the second circumferential grooves in the circumferential direction, wherein at least one of the first and the second circumferential grooves is an elongate groove extending in a direction of a center axis of the hydraulic lash adjuster, said at least one of the first and the second circumferential grooves has an axial length greater than a maximum moveable distance of the plunger relative to the cylindrical housing for adjusting a valve clearance, and the linear member insertion hole is an oil supply passage.

2. The lash adjuster according to claim 1, wherein the first circumferential groove extends entirely around the outer periphery of the plunger, and the second circumferential groove extends entirely around the inner periphery of the cylindrical housing, and the flexible linear member is disposed entirely around the plunger and in the space formed by the first and the second circumferential grooves.

* * * * *